US011382829B2

(12) United States Patent
He

(10) Patent No.: US 11,382,829 B2
(45) Date of Patent: Jul. 12, 2022

(54) ELECTRONIC STEAM SEAT

(71) Applicant: Leiamoon LLC, Pawling, NY (US)

(72) Inventor: Michael He, Shenzhen (CN)

(73) Assignee: Leiamoon LLC, Pawling, NY (US)

( * ) Notice: Subject to any disclaimer, the term of this patent is extended or adjusted under 35 U.S.C. 154(b) by 0 days.

(21) Appl. No.: 17/145,824

(22) Filed: Jan. 11, 2021

(65) Prior Publication Data

US 2021/0212891 A1 Jul. 15, 2021

Related U.S. Application Data

(60) Provisional application No. 62/959,643, filed on Jan. 10, 2020.

(51) Int. Cl.
*A61H 33/10* (2006.01)
*A61H 33/06* (2006.01)

(52) U.S. Cl.
CPC ..... *A61H 33/10* (2013.01); *A61H 2033/068* (2013.01); *A61H 2201/0149* (2013.01); *A61H 2201/0207* (2013.01); *A61H 2201/5082* (2013.01); *A61H 2203/0431* (2013.01); *A61H 2205/087* (2013.01)

(58) Field of Classification Search
CPC ..... A61H 33/10
USPC ..... 4/590, 589, 591, 592, 593
See application file for complete search history.

(56) References Cited

U.S. PATENT DOCUMENTS 4,206,520 A * 6/1980 Fulford ..... E03D 9/08 4/420.2
4,326,308 A * 4/1982 Silver ..... E03D 9/085 4/420.3
4,411,030 A * 10/1983 Kawai ..... A47K 7/08 4/420.2
4,422,189 A * 12/1983 Couvrette ..... E03D 9/08 4/420.2
4,862,526 A * 9/1989 Berger ..... A61H 33/06 4/536
5,058,217 A * 10/1991 Taguchi ..... F24H 9/1872 4/420
6,105,178 A * 8/2000 Kurisaki ..... E03D 9/08 4/420.4
6,186,988 B1 * 2/2001 Sabacinski ..... A61M 3/025 137/893
6,904,624 B2 * 6/2005 Leung ..... A61H 33/12 4/524

(Continued)

*Primary Examiner* — Lori L Baker
(74) *Attorney, Agent, or Firm* — Lee Sullivan Shea & Smith LLP

(57) ABSTRACT

An electronic steam seat device includes a base section that is removably engaged to a steam chamber that is removably engaged to a seat section. The base section includes (i) a receptacle removably positioned in its central cavity, (ii) a heating element for heating the receptacle, (iii) a control interface, and (iv) a control system configured to operate the heating element based on temperature data. The steam chamber includes (i) a temperature sensor positioned at a top portion of the steam chamber and configured to provide the temperature data to the control system for operating the heating element, (ii) a conductive contact that is positioned along a bottom edge of the steam chamber and removably coupled to the control system when the steam chamber is engaged with the base section, and (iii) a cable that connects the temperature sensor to the conductive contact.

20 Claims, 10 Drawing Sheets

(56) References Cited

U.S. PATENT DOCUMENTS 6,968,580 B1 * 11/2005 Chang Chien ..... A47K 7/08 4/420.2
7,849,528 B1 * 12/2010 Tuday ..... A61H 33/10 4/498
8,499,374 B2 * 8/2013 Belkin ..... A61H 33/14 4/524
9,168,199 B2 * 10/2015 Li ..... A61M 35/00
9,428,898 B1 * 8/2016 Clements ..... E03D 9/08
9,517,177 B2 * 12/2016 Oh ..... A61H 33/066
10,526,774 B2 * 1/2020 Schwab ..... E03D 9/08
10,563,390 B2 * 2/2020 Schwab ..... B05B 15/62
D879,486 S * 3/2020 Pratt ..... D6/349
D902,418 S * 11/2020 Goulborne ..... D24/203
10,869,583 B2 * 12/2020 Schwab ..... A61M 11/08
10,912,878 B2 * 2/2021 Schwab ..... A61M 3/0279
10,982,422 B2 * 4/2021 Schwab ..... B05B 7/32
11,071,688 B2 * 7/2021 Freier ..... F22B 1/287
11,147,738 B1 * 10/2021 Nunez ..... A61H 1/00
2003/0140407 A1 * 7/2003 Matsumoto ..... E03D 9/08 4/420.4
2005/0246828 A1 * 11/2005 Shirai ..... E03D 9/08 4/420.4
2007/0011802 A1 * 1/2007 Holland ..... A47K 3/26 4/445
2007/0256225 A1 * 11/2007 Kim ..... G05D 23/19 4/420.2
2009/0025131 A1 * 1/2009 Yamamoto ..... A47K 13/305 4/420
2011/0209283 A1 * 9/2011 Chen ..... A61H 33/066 4/524
2012/0124730 A1 * 5/2012 Morotomi ..... E03D 9/08 4/443
2013/0267890 A1 * 10/2013 Li ..... A61M 35/00 604/24
2013/0305448 A1 * 11/2013 Nguyen ..... A61H 33/06 4/533
2017/0020781 A1 * 1/2017 Tang ..... A45D 44/02
2020/0345579 A1 * 11/2020 Luong ..... A61H 33/0095
2021/0077346 A1 * 3/2021 Luong ..... A47C 1/04
2021/0106191 A1 * 4/2021 Chung ..... A61G 7/1007
2021/0154087 A1 * 5/2021 Arsin ..... A61H 9/0007

* cited by examiner

ELECTRONIC STEAM SEAT

CROSS-REFERENCE TO RELATED APPLICATION

This application claims the benefit under 35 U.S.C. § 119 of U.S. Provisional Patent App. No. 62/959,643, filed Jan. 10, 2020, which is incorporated herein by reference in its entirety.

BACKGROUND

Vaginal steaming is a form of feminine self-care that has been practiced across cultures for many years. Traditionally, the practice involves a woman boiling a pot of water, adding herbs, and then positioning herself (e.g., by squatting or sitting) above the rising herb-infused steam. However, the temperature and the quantity of steam that is generated can be difficult to control with precision. Care must be taken to avoid burns, which may occur accidentally if the temperature of the steam is not known, or if a user stumbles or loses her balance close to the near-boiling water. Further, squatting for an extended period can be difficult or uncomfortable for some women. Therefore, any tool that can make the vaginal steaming process simpler, safer, and more comfortable is desired.

DETAILED DESCRIPTION

The following disclosure makes reference to the accompanying figures and several example embodiments. One of ordinary skill in the art should understand that such references are for the purpose of explanation only and are therefore not meant to be limiting. Part or all of the disclosed systems, devices, and methods may be rearranged, combined, added to, and/or removed in a variety of manners, each of which is contemplated herein.

I. Example Electronic Steam Seat

The present disclosure is generally directed to an electronic steam seat that addresses many of the drawbacks of traditional vaginal steaming practices. In particular, the electronic steam seat described in the examples below provides a device that is comfortable to use and relatively easy to operate, with improved capabilities for controlling steam temperature and quantity.

FIGS. 1-5 show various views of an example electronic steam seat 100 according to some embodiments discussed herein. As shown, the electronic steam seat 100 may be formed from a multipart housing that includes a base section 102 at its bottom, a middle section or steam chamber 104 positioned atop the base section 102, and a seat section 106 positioned atop the steam chamber 104.

Figure 5:
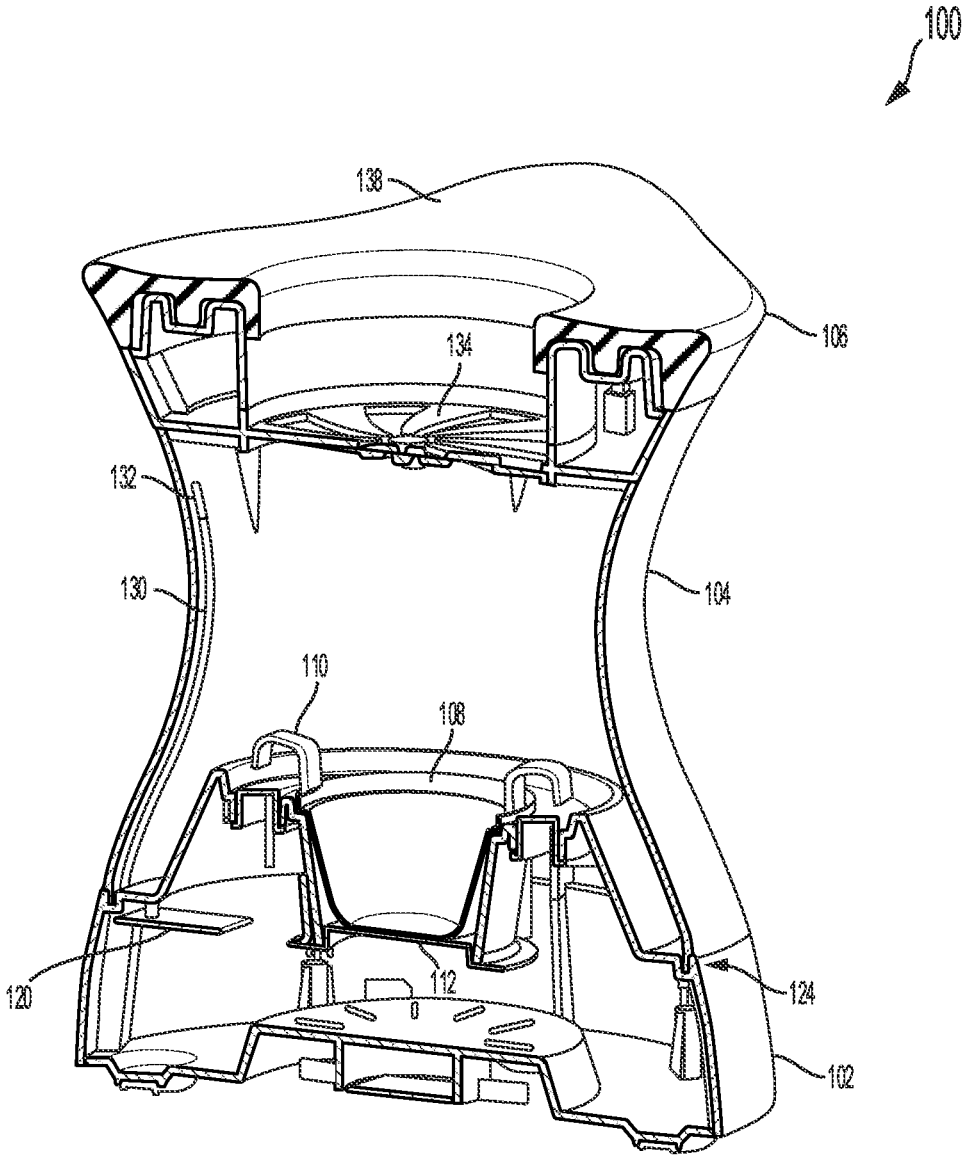
FIG. 5 depicts a cross-sectional view of an electronic steam seat according to an example implementation.

Each section of the housing may be removably coupled to the adjacent section(s) such that the electronic steam seat 100 is easy to assemble and disassemble. For instance, in some implementations, the steam chamber 104 may include a protruding edge that sits within a corresponding groove in the base section 102, forming a tongue-in-groove type of engagement 124, as depicted in FIG. 5. A similar connection may be made between the seat section 106 and the steam chamber 104. In some embodiments, this interconnection may be the only means of coupling the sections of the electronic steam seat housing, which may facilitate easy disassembly of the electronic steam seat 100. In some other implementations, the sections of the housing may be rotatable with respect to each other after the respective protruding edges and grooves are engaged. Such a rotation may engage one or more locking channels to lock the sections into engagement with one another, for instance. Numerous other possibilities for coupling the housing sections together exist. Further, although the examples discussed herein include an electronic steam seat 100 that includes three housing sections, other arrangements including more or fewer sections are also possible.

Figure 6:
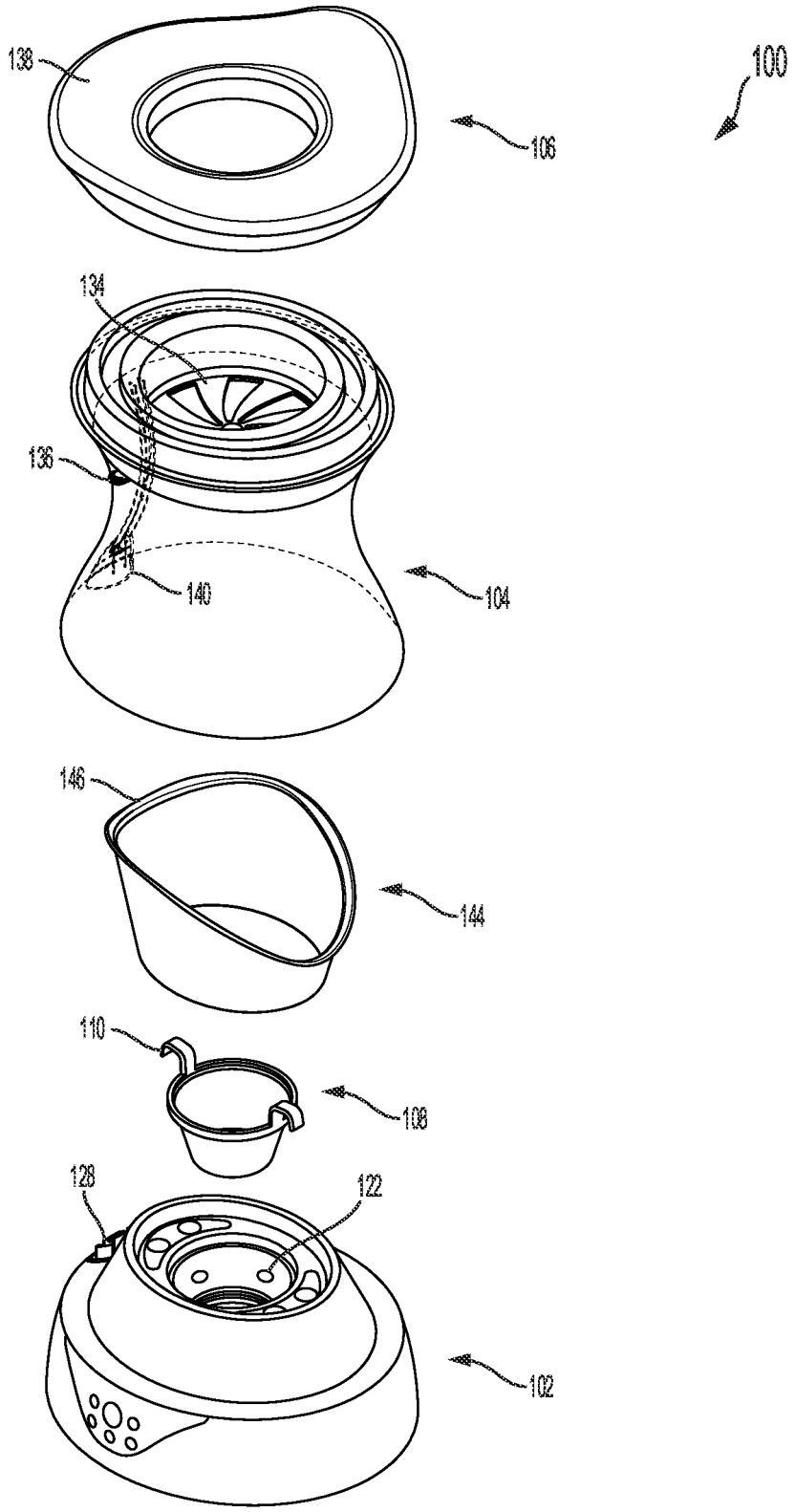
FIG. 6 depicts an exploded view of an electronic steam seat according to an example implementation.

Turning now to FIG. 6, an exploded view of the electronic steam seat 100 shown in FIGS. 1-5 is depicted. The individual housing sections and several additional components of the electronic steam seat 100 are shown. Each of these will be discussed in further detail below in conjunction with FIG. 5, which depicts an assembled, cross-sectional view of the electronic steam seat 100.

A. Example Base Section of an Electronic Steam Seat

As shown in FIGS. 5 and 6, the base section 102 of the electronic steam seat 100 may include a receptacle 108 for holding water and herbs that are to be heated. In some implementations, such as the examples shown in FIGS. 5 and 6, the receptacle 108 may be formed from stainless steel for durability and ease of cleaning, although other appropriate materials are also possible. Further, the receptacle 108 is removable from the base section 102 to allow for easy filling, cleaning, and refilling of the water and herbs that are to be used for the steaming process. Accordingly, the receptacle 108 may include one or more handles or hooks 110, as shown, to facilitate handling.

The receptacle 108 may be sized to nest within a central area of the base section 102 that includes one or more heating elements 112. The heating elements 112 can include a heating element configured to contact the receptacle 108 and heat the receptacle 108 through conductive heating. For example, the base section 102 may include a cavity at its center that holds the receptacle 108 and heats the contents of the receptacle via an integrated heating plate or similar electric heat source. The heating element 112 may be controlled via a control interface 114 positioned on an outside surface of the base section 102, as seen most clearly in FIGS. 1 and 3. The control interface 114 may include a plurality of buttons 116 for adjusting the settings of the electronic steam seat 100, as well as a display 118 for providing visual feedback including, for example, the current temperature of the steam within the steam chamber 104, as discussed further below.

The control interface 114 and the heating element 112 may be controlled via a control system 120 housed within the base section 102. For example, a control system 120 may be provided on a printed circuit board, as shown in FIG. 5, that includes a processor and a non-transitory, computer readable medium housing program instructions that are executable by the processor to perform operations for controlling the electronic steam seat 100. For example, the processor may receive input data from the control interface 114 corresponding to button presses by a user of the electronic steam seat 100. The input data may indicate a command to increase or decrease the steam temperature, or the input data may indicate a desired steam temperature setting. In response, the processor may correspondingly increase or decrease the heat output of the heating element 112.

As shown in FIG. 6, the base section 102 may also include one or more light sources 122, such as infrared or near-infrared lights. In some implementations, these light sources 122 may provide a source of radiant heat that may be utilized in conjunction with the heated steam during vaginal steaming. Accordingly, the control interface 114 may include one or more buttons 116 for operating the one or more light sources 122 via the control system 120 discussed above.

B. Example Steam Chamber of an Electronic Steam Seat

Referring again to FIGS. 5 and 6, the middle section or steam chamber 104 of the electronic steam seat 100 is shown fitting atop the base section 102. As discussed above, the bottom edge of the steam chamber 104 may be coupled with the base section 102 in a tongue-in-groove engagement 124, as seen in the cross-section of FIG. 5.

Figure 7:
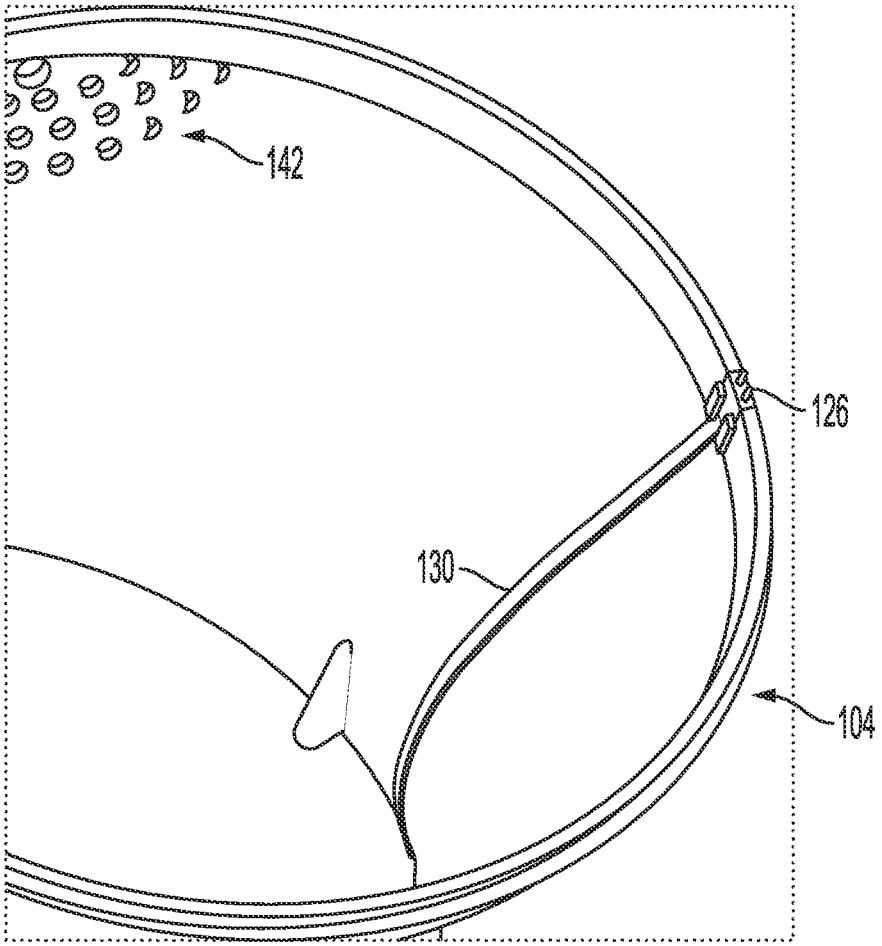
FIG. 7 depicts a bottom, perspective view of a portion of a steam chamber according to an example implementation.
Figure 8:
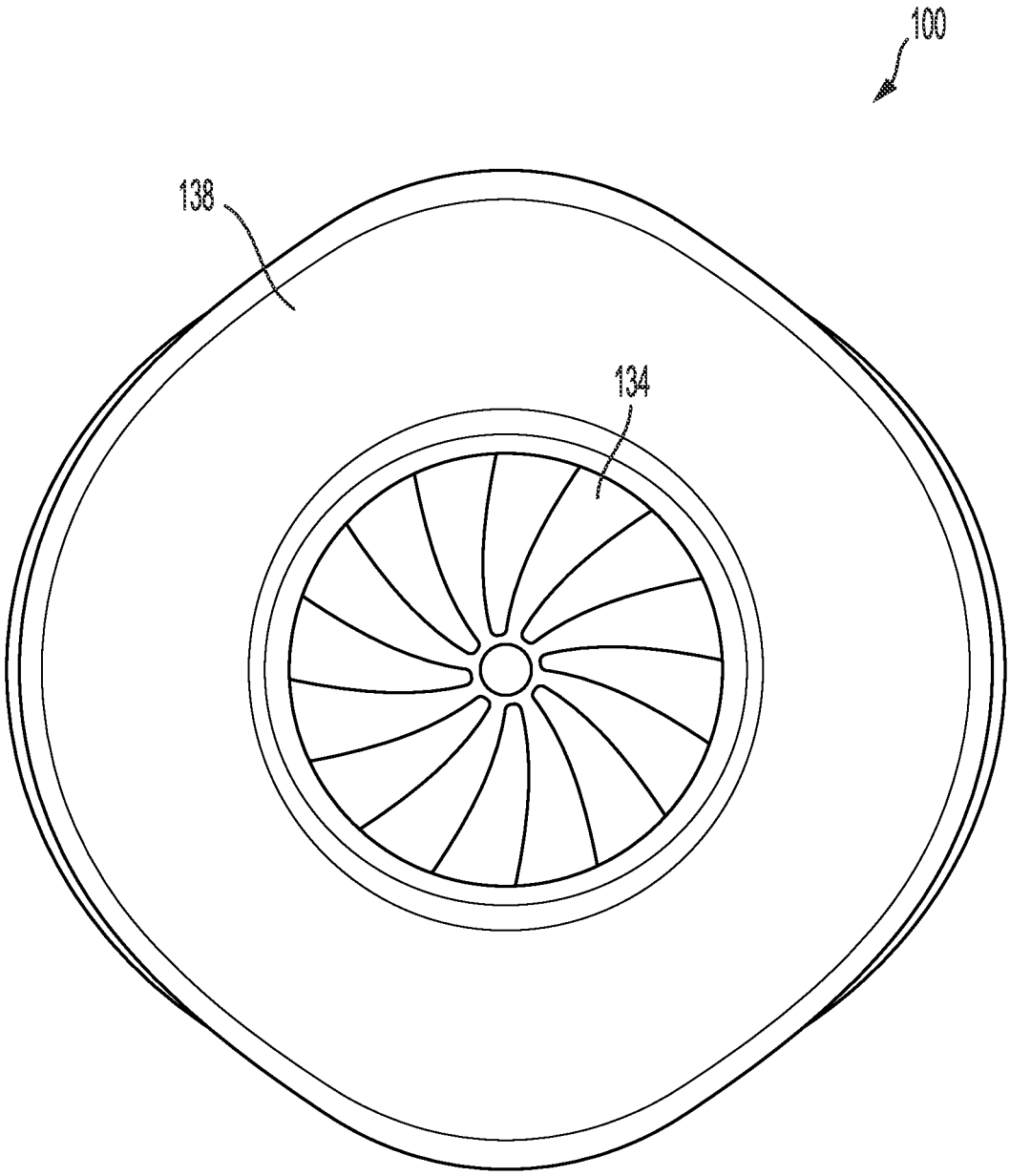
FIG. 8 depicts a top view of an electronic steam seat according to an example implementation.

In some embodiments, the bottom edge of the steam chamber 104 may include a conductive contact for electrically connecting further components in the steam chamber 104 to the control system 120. For example, FIG. 7 shows a bottom perspective view of a portion of the steam chamber 104, disconnected from the base section 102. A conductive contact 126, shown in FIG. 7 as a pair of conductive pins, is positioned along a perimeter of the bottom edge of the steam chamber 104. The pins 126 are positioned to connect to a corresponding conductive contact 128 on the base section 102, shown in FIG. 6. The conductive contact 128 is connected to the control system 120 and may be arranged in proximity to the control system 120.

As shown in FIGS. 6 and 7, a cable 130 extends from the pins 126 at the bottom edge of the steam chamber to a temperature sensor 132 at or near the top edge of the steam chamber 104. Accordingly, once the steam chamber 104 is positioned such that the pins 126 are engaged with the conductive contact 128 on the base section 102, the temperature sensor 132 may detect the temperature at or near the top of the steam chamber 104 and provide corresponding temperature data to the control system 120. This temperature data may be provided to a user, for example, on the display 118 of the control interface 114, giving a useful reference for a user to control the temperature setting of the electronic steam seat 100.

Moreover, the arrangement discussed herein provides for temperature detection that is remote from the heating source 112 and positioned much closer to a user's skin. Thus, this arrangement may more accurately account for temperature changes that occur as the steam rises from the bottom of the steam chamber 104 to the top. Accordingly, the temperature sensor 132 according to the examples discussed herein may provide temperature data that is more accurate than data from a sensor that is, for example, integrated into or positioned adjacent to the heating element 112.

Based on the arrangement shown, the temperature sensor 132 may provide feedback for the control system 120 that allows a user to accurately increase, decrease, or maintain a desired steam temperature for the electronic steam seat 100. For example, when a user sets the initial temperature setting of the electronic steam seat 100 to a desired temperature, the control system 120 may activate the heating element 112. As the water in the receptacle 108 heats and steam begins to form, the control system 120 may receive corresponding temperature data from the temperature sensor 132. Once the desired temperature is reached, according to the temperature detected by the temperature sensor 132 at the top of the steam chamber 104, the control system 120 may reduce the heat applied by the heating element 112 so that the temperature stops increasing. If the temperature sensor 132 detects that the temperature begins to drop below the desired temperature, the control system 120 may responsively increase the applied heat. In this way, a feedback loop is created that allows for improved temperature control and correspondingly improved user safety.

In FIGS. 1-4, the cable 130 can be seen extending from the bottom of the steam chamber 104 to the top. In some implementations, the cable 130 may be fixed to the interior wall of the steam chamber 104, such as with a water and heat resistant adhesive. In some other examples, the cable 130 may be integrated into the wall of the steam chamber 104. For example, the cable 130 may have a given cross-sectional shape that fits into a correspondingly shaped notch or groove in the steam chamber wall. As another example, the cable 130 may be placed into a mold prior to, or in the process of, forming the steam chamber 104, such that the wall of the steam chamber 104 is molded around the cable 130. Other examples are also possible.

In FIGS. 1, 2, 5, 6, and 8, a valve 134 is shown at the top of the steam chamber 104. A slidable tab 136 for controlling the open or closed position of the valve 134 is located on the exterior sidewall of the steam chamber 104. In some cases, the slidable tab 136 may be mechanically coupled to the valve 134 such that sliding the tab 136 engages the valve 134 to open and close it (e.g., by rotating). However, it is contemplated that in some embodiments, the valve 134 might also be electronically controlled via the control interface 114. For example, a motor can be mechanically coupled to the valve 134 for operating the valve 134. The motor can be included as part of the steam chamber 104 and/or part of the valve 134 itself, and the cable 130 connecting the temperature sensor 132 to the conductive contact 126 at the bottom edge of the steam chamber 104 may also be connected to the motor, such that the control system 120 can operate the motor by sending signals to the motor through the cable 130 based on user input received via the control interface 114.

Further, the valve may be operable between a range of positions encompassing "fully open" and "fully closed." For example, a user may manipulate the slidable tab 136 or an electronic control such that the valve 134 is positioned to be only half-way open. In this way, a user may be provided with increased control over the amount of steam that can escape the steam chamber 104.

As shown in FIGS. 1-4, the steam chamber 104 may further include an enclosure 140 positioned on the sidewall of the steam chamber 104 at or near the bottom edge of the steam chamber 104. The enclosure 140 may entirely or partially isolate the conductive contact 126 from the central cavity of the steam chamber 104. In operation, steam accumulates in the central cavity of the steam chamber 104, and the enclosure 140 may reduce an extent to which the conductive contact 126 is exposed to the steam. This can be helpful for reducing or preventing water from reaching and interfering with the electronics of the control system 120.

Figure 1:
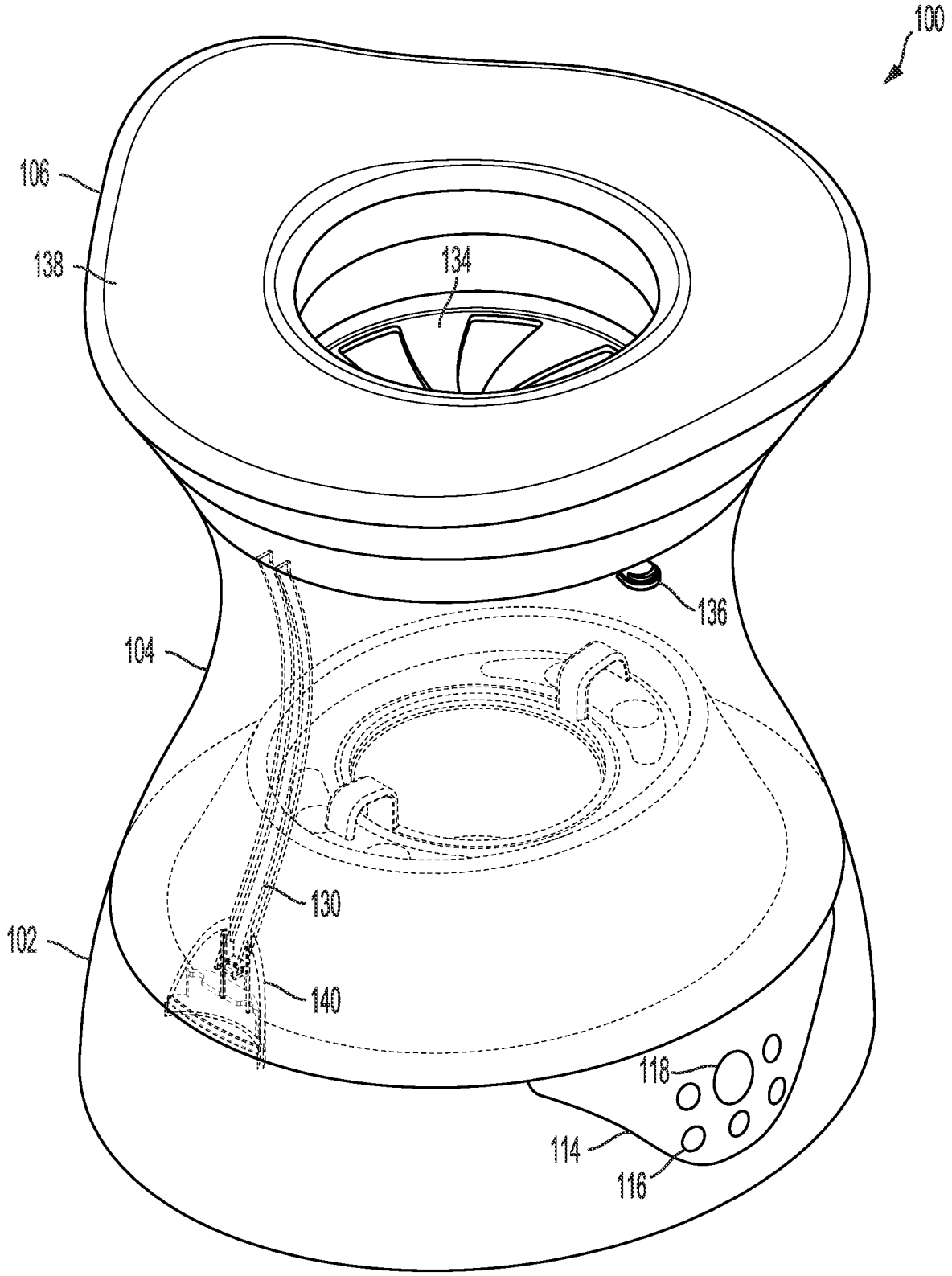
FIG. 1 depicts a front perspective view of an electronic steam seat according to an example implementation.
Figure 2:
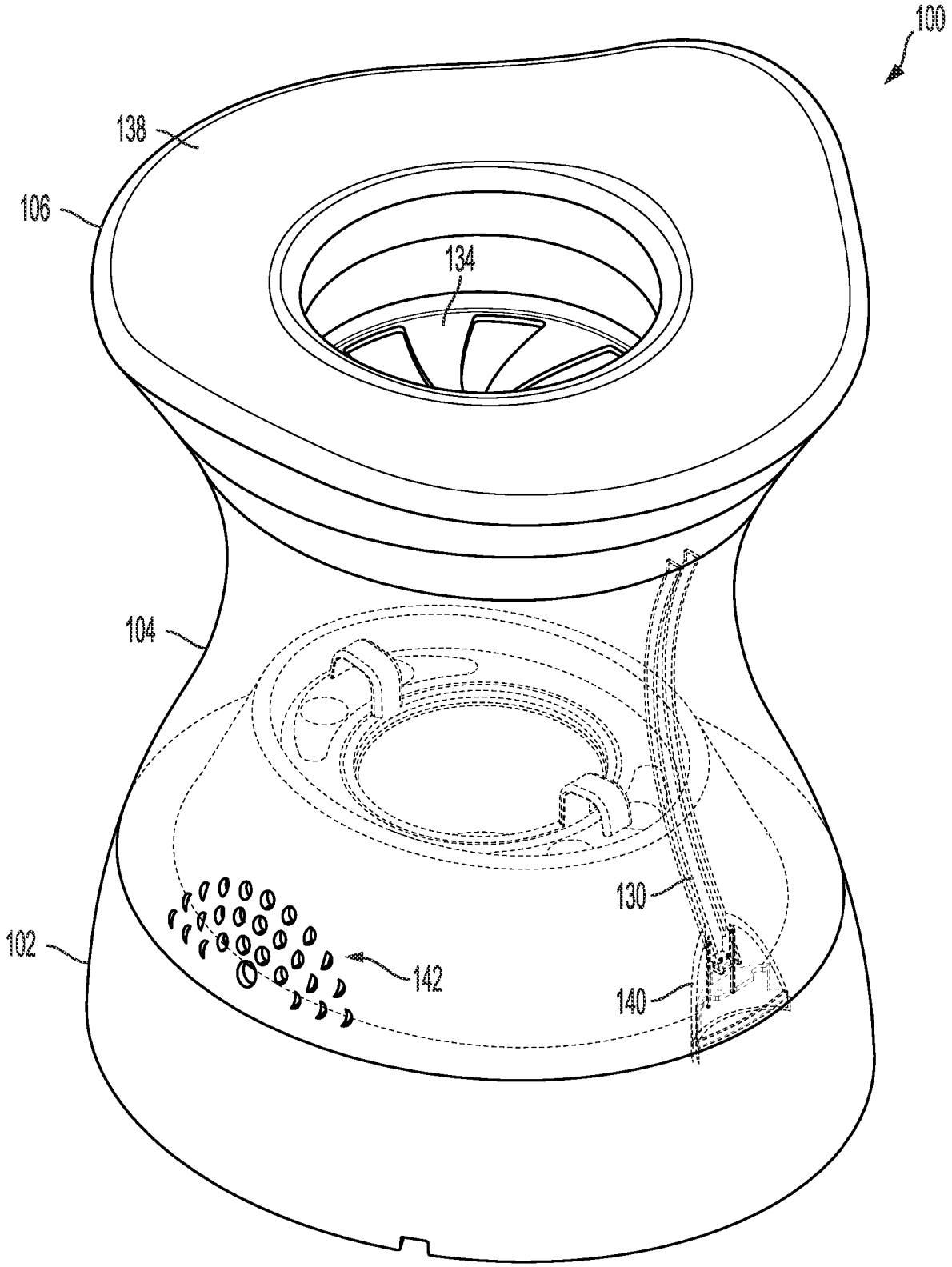
FIG. 2 depicts a rear perspective view of an electronic steam seat according to an example implementation.
Figure 3:
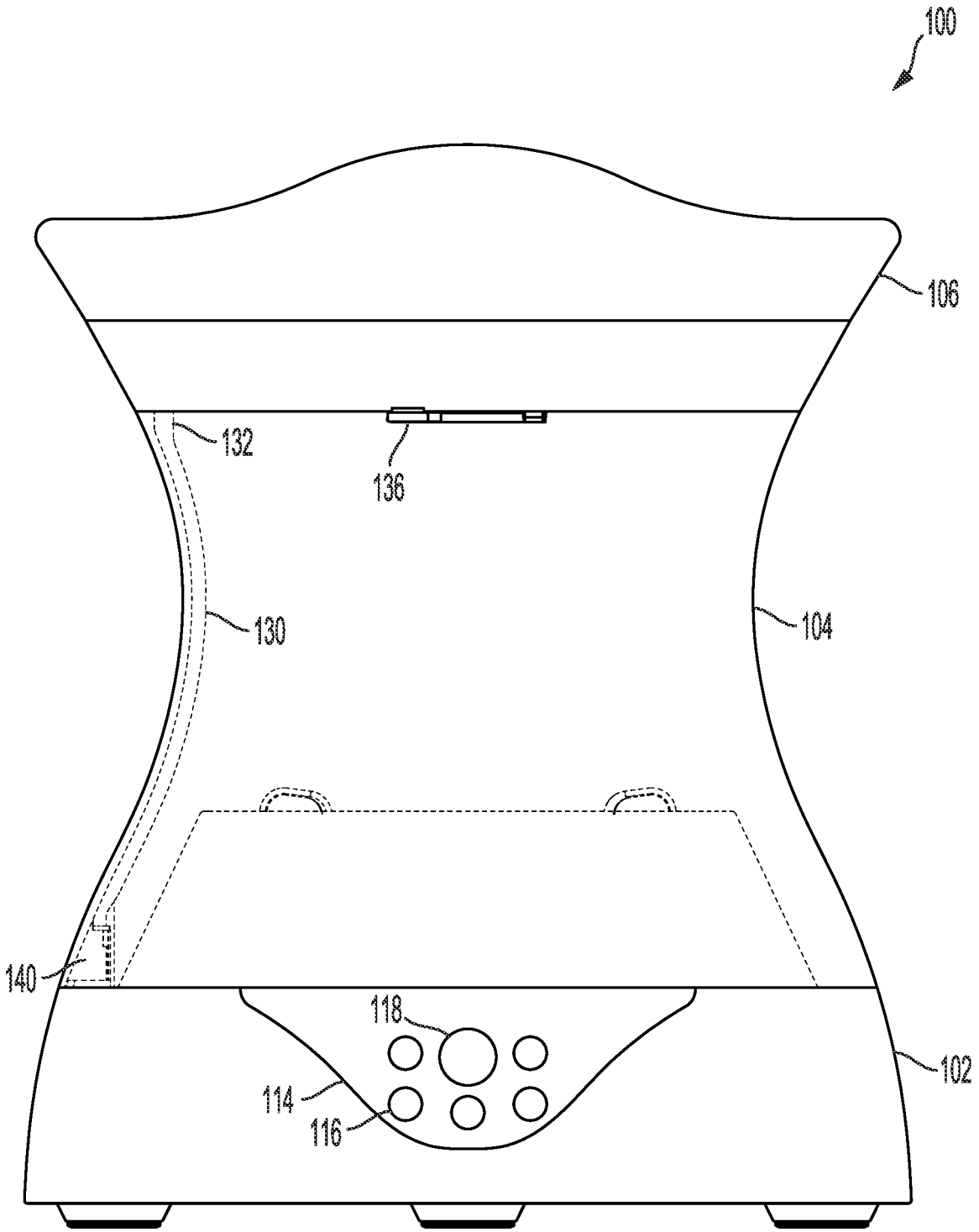
FIG. 3 depicts a front view of an electronic steam seat according to an example implementation.
Figure 4:
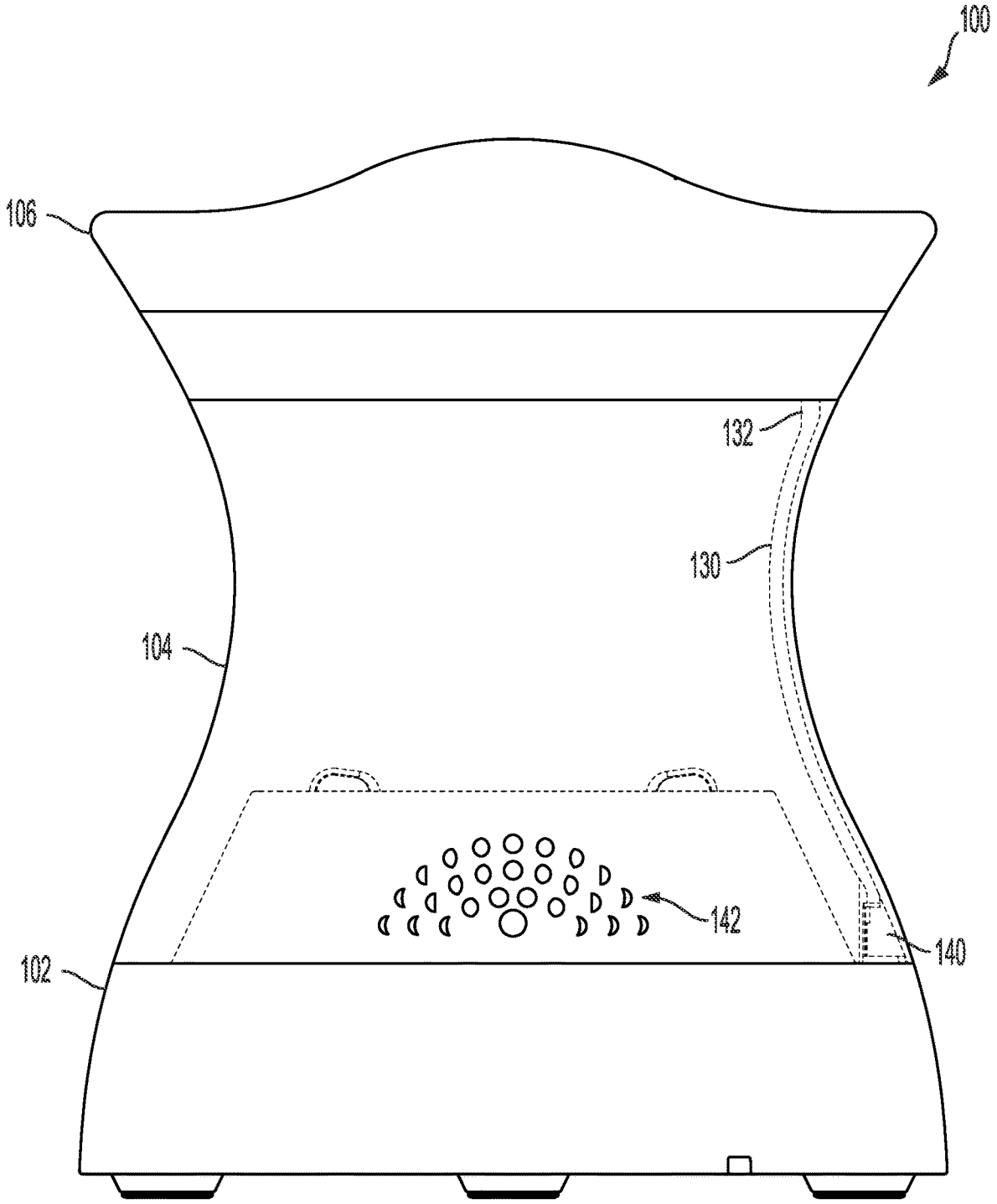
FIG. 4 depicts a rear view of an electronic steam seat according to an example implementation.

As shown in FIGS. 2, 4, and 7, the steam chamber 104 may further include a vent 142 for venting the interior of the steam chamber 104 to the exterior of the steam chamber 104. The vent 142 may help the steam chamber 104 dry out faster after use, which may help prevent mold growth inside the steam chamber. However, the vent 142 may also allow steam to escape the steam chamber 104 during operation. To address this, in some examples and as shown in FIGS. 2, 4, and 7, the vent 142 may be arranged near the bottom of the steam chamber 104, below the top of the receptacle 108. In such an arrangement, steam rising out of the receptacle 108 is less likely to escape the steam chamber 104 through the vent 142.

C. Example Seat Section of an Electronic Steam Seat

As shown in FIGS. 1-6 and 8, the seat section 106 is positioned atop the steam chamber 104 and includes an ergonomically contoured seating surface 138. In some implementations, the contoured seating surface 138 may be cushioned for increased comfort. Similar to the connection between the steam chamber 104 and the base section 102, the seat section 106 may be connected to the steam chamber 104 using a tongue-in-groove style engagement, similar to the tongue-in-groove style engagement 124 depicted in FIG. 5. One advantage of the tongue-in-groove connection is that the seat section 106 may be rotatable with respect to the steam chamber 104. This may allow a user to rotate the seat section 106 to a particular orientation that is more comfortable for operating one or both of the control interface 114 or the slidable tab 136.

Although the seat section 106 does not include any electronic components in the examples discussed herein, such variations are fully contemplated by the present discussion. For instance, in some embodiments the seat section 106 and steam chamber 104 may include a set of conductive contacts similar to those shown and discussed above, providing an electrical connection to the control system 120 for communication with the control system 120. This may allow for an implementation in which the temperature sensor 132 is located in the seat section 106, for example. Other arrangements are also possible.

D. Additional Configurations of an Electronic Steam Seat

As shown in FIG. 6, the electronic steam seat 100 may, in some implementations, include a facial attachment 144, which can be used to convert the electronic steam seat 100 from a vaginal steaming configuration into a facial steaming configuration. An upper edge of the facial attachment 144 can be a contoured edge 146 such that the edge 146 is contoured to fit a human face. The contoured edge 146 can be cushioned for improved comfort when placed against a user's face.

As depicted in the exploded view shown in FIG. 6, the facial attachment 144 may be positioned inside the steam chamber 104, and a bottom edge of the facial attachment 144 may removably engage with the base section 102. For instance, the bottom edge of the facial attachment 144 may engage the central area of the base section 102 and may surround the receptacle 108, such that the receptacle 108 is nested inside the facial attachment 144. In such a configuration, a user may remove the steam chamber 104 and the seat section 106 from the electronic steam seat 100 to access and use the facial attachment 144.

In other examples, the facial attachment 144 may be arranged in other configurations. For instance, the bottom edge of the facial attachment 144 may be configured to removably engage with the upper edge of the steam chamber 104 in the same manner or in a similar manner as the seat section 106. In this configuration, a user may replace the seat section 106 with the facial attachment 144 to use the electronic steam seat 100 in the facial steaming configuration. As another example, the bottom edge of the facial attachment 144 may be configured to removably engage with an upper edge of the seat section 106. In this implementation, the facial attachment 144 may be stored inside the steam chamber 104 in the arrangement depicted in FIG. 6 while in the vaginal steaming configuration and installed on top of the seat section 106 to convert the electronic steam seat 100 into the facial steaming configuration. Other examples are possible as well.

E. Example Methods in Connection with an Electronic Steam Seat

Figure 9:
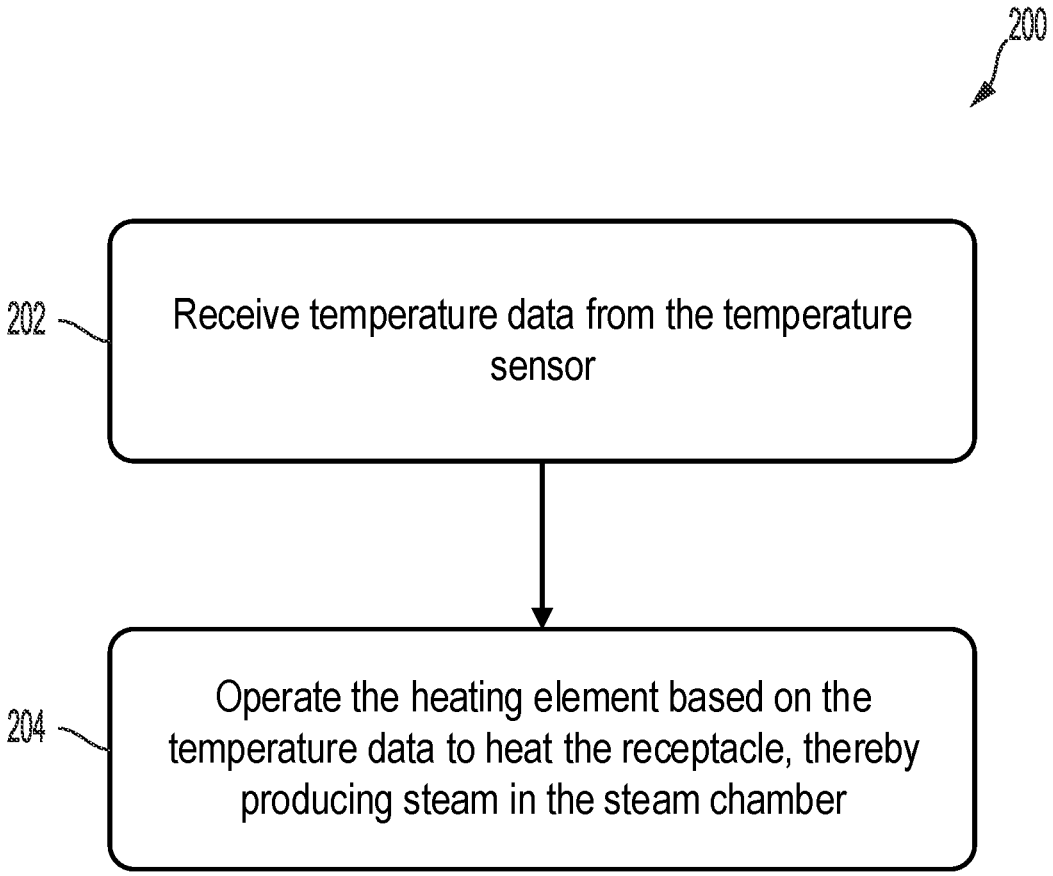
FIG. 9 is a flowchart of an example method performed by an electronic steam seat.

FIG. 9 depicts an example method 200. The method 200 may be performed by an electronic steam seat, such as the examples of the electronic steam seat 100 described herein. As such, the electronic steam seat may include a base section, a steam chamber, and a seat section. The base section may include a central cavity, an exterior surface, an upper edge, a receptacle containing water and removably positioned in the central cavity, a heating element arranged to heat the receptacle in the central cavity, a control system configured to operate the heating element, and a control interface positioned on the exterior surface. The steam chamber may include an upper edge, a bottom edge removably engaged with the upper edge of the base section, a sidewall, a temperature sensor positioned at a top portion of the steam chamber, a conductive contact positioned along the bottom edge of the steam chamber and removably coupled to the control system, and a cable fixed to the sidewall of the steam chamber and connecting the temperature sensor to the conductive contact. The seat section may include a contoured seating surface and a bottom edge removably engaged with the upper edge of the steam chamber.

At block 202, the method 200 involves the control system of the electronic steam seat receiving temperature data from the temperature sensor. As described above, the temperature sensor is arranged at the top portion of the steam chamber near the seat section, such that the temperature sensor obtains temperature data that more accurately reflects the temperature of steam that is exposed to the user's skin.

At block 204, the method 200 involves the control system of the electronic steam seat operating the heating element based on the temperature data to heat the receptacle, thereby producing steam in the steam chamber from the water in the receptacle.

In some examples, the method 200 further involves the control system of the electronic steam seat receiving, via the control interface, an input temperature setting. The control system may determine a steam temperature based on the temperature data received from the temperature sensor. In these examples, the control system operating the heating element based on the temperature data may involve (i) increasing a temperature of the heating element when the steam temperature is below the input temperature setting and (ii) decreasing the temperature of the heating element when the steam temperature is above the input temperature setting. The heating element may include a conductive heating element and/or a radiative heating element, such that operating the heating element may involve operating the conductive heating element to heat the receptacle through conductive heating and/or operating the radiative heating element to heat the receptacle through radiative heating.

In line with the discussion above, the steam chamber may further include a valve positioned near the top of the steam chamber for controlling a flow of steam from the steam chamber to the seat section. In such examples, the method 200 may further involve the control system operating the valve to control the flow of the steam from the steam chamber to the seat section. For instance, the electronic steam seat may include a motor mechanically coupled to the valve and electrically coupled to the control system such that the control system may control the motor to operate the valve.

Figure 10:
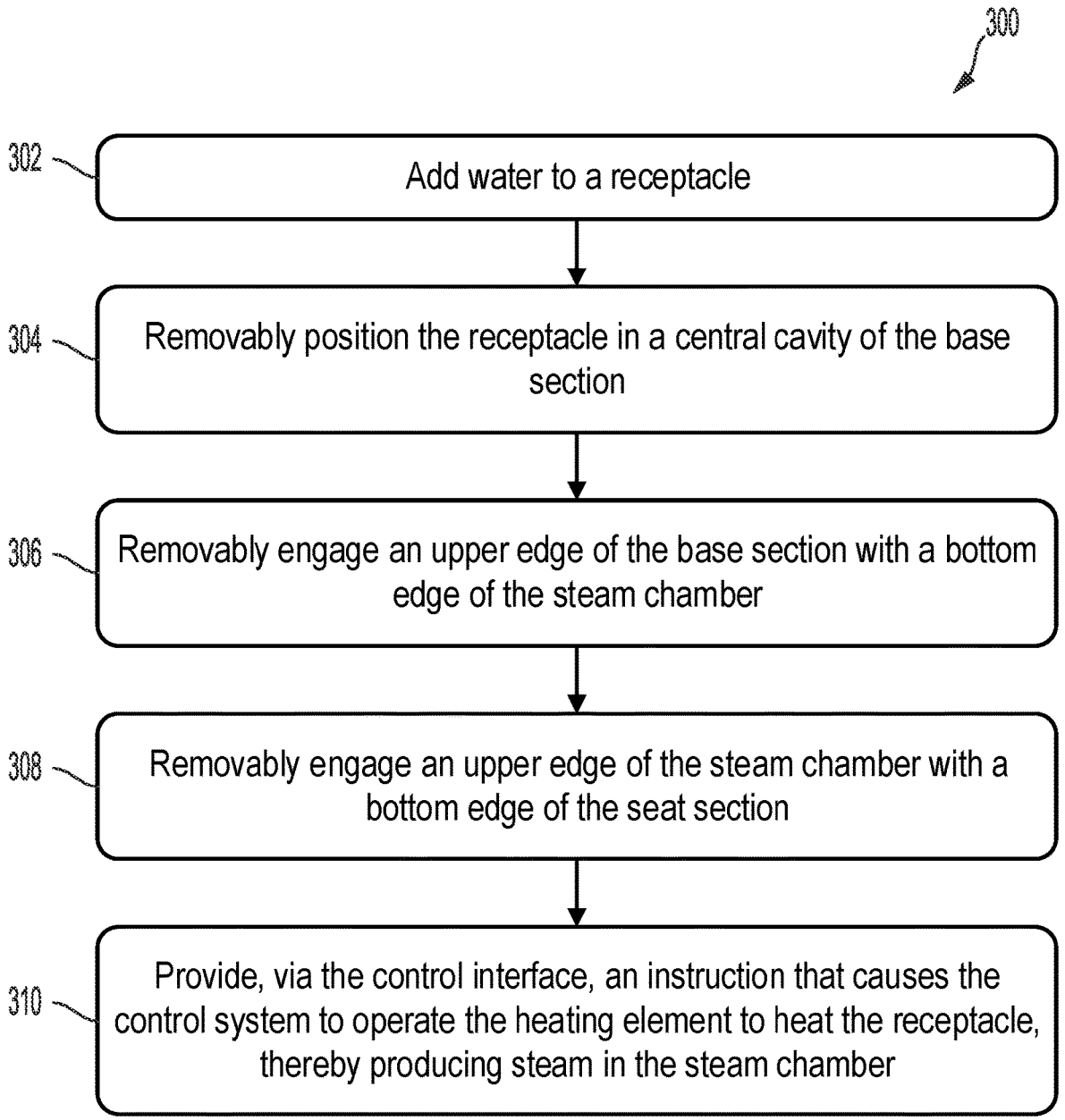
FIG. 10 is a flowchart of an example method of operating an electronic steam seat.

FIG. 10 depicts another example method 300. The method 300 may be performed in connection with an electronic steam seat, such as the examples of the electronic steam seat 100 described herein. As such, the electronic steam seat may include a base section, a steam chamber, and a seat section.

At block 302, the method 300 involves adding water to a receptacle. The receptacle may be the receptacle 108 shown in FIGS. 5 and 6. In line with the discussion above, herbs may be added to the receptacle as well.

At block 304, the method 300 involves removably positioning the receptacle in a central cavity of the base section. The base section includes a heating element arranged to heat the receptacle in the central cavity, a control system configured to operate the heating element based on temperature data, and a control interface positioned on an exterior surface of the base section.

At block 306, the method 300 involves removably engaging an upper edge of the base section with a bottom edge of the steam chamber. The steam chamber includes a temperature sensor positioned at a top portion of the steam chamber, a conductive contact positioned along the bottom edge of the steam chamber, and a cable fixed to a sidewall of the steam chamber. The cable connects the temperature sensor to the conductive contact, and removably engaging the upper edge of the base section with the bottom edge of the steam chamber removably couples the conductive contact to the control system such that the temperature sensor provides the temperature data to the control system via the conductive contact.

At block 308, the method 300 involves removably engaging an upper edge of the steam chamber with a bottom edge of the seat section. The seat section includes a contoured seating surface, and removably engaging the upper edge of the steam chamber with the bottom edge of the seat section causes the contoured seating surface to be positioned above the steam chamber.

At block 310, the method 300 involves providing, via the control interface, an instruction that causes the control system to operate the heating element to heat the receptacle, thereby producing steam in the steam chamber from the water in the receptacle. In line with the discussion above, providing the instruction via the control interface may involve inputting a desired steam temperature setting. In such examples, the control system may be configured to determine a steam temperature based on the temperature data provided by the temperature sensor and adjust a temperature of the heating element by (i) increasing a temperature of the heating element when the steam temperature is below the input temperature setting or (ii) decreasing the temperature of the heating element when the steam temperature is above the input temperature setting.

In some examples, the steam chamber further includes a valve configured to control a flow of steam from the steam chamber to the seat section, and the method 300 further involves setting the valve to a position within a range of positions encompassing a fully open position and a fully closed position. For instance, the steam chamber may further include a slidable tab mechanically coupled to the valve, and setting the valve to the position may involve sliding the tab to engage the valve until the valve is set to the position.

II. Conclusion

Example embodiments of the disclosed innovations have been described above. Those skilled in the art will understand, however, that changes and modifications may be made to the embodiments described without departing from the true scope and sprit of the present invention, which will be defined by claims.

To the extent that examples described herein involve operations performed or initiated by actors, such as "operators," "users" or other entities, this is for purposes of example and explanation only. Claims should not be construed as requiring action by such actors unless explicitly recited in claim language.

The invention claimed is:

1. An electronic steam seat device comprising:

a base section including a central cavity, an exterior surface, and an upper edge, the base section further comprising:

a receptacle removably positioned in the central cavity;

a heating element arranged to heat the receptacle in the central cavity;

a control system configured to operate the heating element based on temperature data; and a control interface positioned on the exterior surface;

a steam chamber including an upper edge, a bottom edge removably engaged with the upper edge of the base section, and a sidewall, the steam chamber further comprising:

a temperature sensor positioned at a top portion of the steam chamber and configured to provide the temperature data to the control system for operating the heating element;

a conductive contact positioned along the bottom edge of the steam chamber, wherein the conductive contact is removably coupled to the control system when the steam chamber is engaged with the base section; and a cable fixed to the sidewall of the steam chamber, wherein the cable connects the temperature sensor to the conductive contact; and a seat section including a contoured seating surface and a bottom edge removably engaged with the upper edge of the steam chamber.

2. The electronic steam seat device of claim 1, wherein the control system is configured to:

receive, via the control interface, an input temperature setting;

determine a steam temperature based on the temperature data provided by the temperature sensor; and operate the heating element to (i) increase a temperature of the heating element when the steam temperature is below the input temperature setting and (ii) decrease the temperature of the heating element when the steam temperature is above the input temperature setting.

3. The electronic steam seat device of claim 1, wherein the steam chamber further comprises an enclosure positioned on the sidewall of the steam chamber, and wherein the enclosure at least partially isolates the conductive contact from a central cavity of the steam chamber, the central cavity of the steam chamber being configured to receive steam when the control system operates the heating element.

4. The electronic steam seat device of claim 1, wherein the steam chamber further comprises a valve configured to control a flow of steam from the steam chamber to the seat section.

5. The electronic steam seat device of claim 4, wherein the valve is operable between a range of positions encompassing a fully open position and a fully closed position.

6. The electronic steam seat device of claim 5, wherein the steam chamber further comprises a slidable tab mechanically coupled to the valve such that sliding the tab engages the valve to operate the valve between the range of positions.

7. The electronic steam seat device of claim 5, further comprising a motor mechanically coupled to the valve, wherein the control system is further configured to control the motor to operate the valve between the range of positions.

8. The electronic steam seat device of claim 1, wherein the heating element comprises a conductive heating element configured to heat the receptacle through conductive heating.

9. The electronic steam seat device of claim 8, wherein the heating element further comprises a radiative heating element configured to heat the receptacle through radiative heating.

10. The electronic steam seat device of claim 1, wherein the sidewall of the steam chamber comprises a groove extending from a bottom portion of the steam chamber to the top portion of the steam chamber, and wherein the cable is positioned within the groove.

11. A method performed by an electronic steam seat device, wherein the electronic steam seat device comprises a base section, a steam chamber, and a seat section, wherein the base section comprises (i) a central cavity, (ii) an exterior surface, (iii) an upper edge, (iv) a receptacle containing water and removably positioned in the central cavity, (v) a heating element arranged to heat the receptacle in the central cavity, (vi) a control system configured to operate the heating element, and (vii) a control interface positioned on the exterior surface, wherein the steam chamber comprises (i) an upper edge, (ii) a bottom edge removably engaged with the upper edge of the base section, (iii) a sidewall, (iv) a temperature sensor positioned at a top portion of the steam chamber, (v) a conductive contact positioned along the bottom edge of the steam chamber and removably coupled to the control system, and (vi) a cable fixed to the sidewall of the steam chamber and connecting the temperature sensor to the conductive contact, and wherein the seat section comprises (i) a contoured seating surface and (ii) a bottom edge removably engaged with the upper edge of the steam chamber, the method comprising:

receiving, by the control system, temperature data from the temperature sensor; and operating, by the control system, the heating element based on the temperature data to heat the receptacle, thereby producing steam in the steam chamber from the water in the receptacle.

12. The method of claim 11, further comprising:

receiving, by the control system via the control interface, an input temperature setting; and determining, by the control system, a steam temperature based on the temperature data received from the temperature sensor, wherein operating the heating element based on the temperature data comprises (i) increasing a temperature of the heating element when the steam temperature is below the input temperature setting and (ii) decreasing the temperature of the heating element when the steam temperature is above the input temperature setting.

13. The method of claim 11, wherein the steam chamber further comprises a valve, and wherein the method further comprises operating, by the control system, the valve to control a flow of the steam from the steam chamber to the seat section.

14. The method of claim 13, wherein the steam chamber further comprises a motor mechanically coupled to the valve, and wherein operating the valve comprises controlling the motor to operate the valve.

15. The method of claim 11, wherein the heating element comprises a conductive heating element, and wherein operating the heating element comprises operating the conductive heating element to heat the receptacle through conductive heating.

16. The method of claim 15, wherein the heating element further comprises a radiative heating element, and wherein operating the heating element comprises operating the radiative heating element to heat the receptacle through radiative heating.

17. A method of operating an electronic steam seat device comprising a base section, a steam chamber, and a seat section, the method comprising:

adding water to a receptacle;

removably positioning the receptacle in a central cavity of the base section, wherein the base section comprises (i) a heating element arranged to heat the receptacle in the central cavity, (ii) a control system configured to operate the heating element based on temperature data, and (iii) a control interface positioned on an exterior surface of the base section;

removably engaging an upper edge of the base section with a bottom edge of the steam chamber, wherein the steam chamber comprises (i) a temperature sensor positioned at a top portion of the steam chamber, (ii) a conductive contact positioned along the bottom edge of the steam chamber, and (iii) a cable fixed to a sidewall of the steam chamber, wherein the cable connects the temperature sensor to the conductive contact, and wherein removably engaging the upper edge of the base section with the bottom edge of the steam chamber removably couples the conductive contact to the control system such that the temperature sensor provides the temperature data to the control system via the conductive contact;

removably engaging an upper edge of the steam chamber with a bottom edge of the seat section, wherein the seat section includes a contoured seating surface, and wherein removably engaging the upper edge of the steam chamber with the bottom edge of the seat section causes the contoured seating surface to be positioned above the steam chamber; and providing, via the control interface, an instruction that causes the control system to operate the heating element to heat the receptacle, thereby producing steam in the steam chamber from the water in the receptacle.

18. The method of claim 17, wherein providing the instruction via the control interface comprises inputting a temperature setting, and wherein the control system is configured to operate the heating element by:

determining a steam temperature based on the temperature data provided by the temperature sensor; and adjusting a temperature of the heating element by (i) increasing a temperature of the heating element when the steam temperature is below the input temperature setting or (ii) decreasing the temperature of the heating element when the steam temperature is above the input temperature setting.

19. The method of claim 17, wherein the steam chamber further comprises a valve configured to control a flow of steam from the steam chamber to the seat section, and wherein the method further comprises setting the valve to a position within a range of positions encompassing a fully open position and a fully closed position.

20. The method of claim 19, wherein the steam chamber further comprises a slidable tab mechanically coupled to the valve, and wherein setting the valve to the position comprises sliding the tab to engage the valve until the valve is set to the position.

* * * * *